US012708144B2

(12) United States Patent
Jin et al.

(10) Patent No.: US 12,708,144 B2
(45) Date of Patent: Aug. 18, 2026

(54) VAPORIZATION DEVICE AND ELECTRONIC CIGARETTE HAVING SAME

(71) Applicant: BYD PRECISION MANUFACTURE CO., LTD., Shenzhen (CN)

(72) Inventors: Qibin Jin, Shenzhen (CN); Yinbo Lu, Shenzhen (CN)

(73) Assignee: BYD PRECISION MANUFACTURE CO., LTD., Shenzhen (CN)

( * ) Notice: Subject to any disclaimer, the term of this patent is extended or adjusted under 35 U.S.C. 154(b) by 467 days.

(21) Appl. No.: 18/344,878

(22) Filed: Jun. 30, 2023

(65) Prior Publication Data

US 2024/0000150 A1 Jan. 4, 2024

(30) Foreign Application Priority Data

Jul. 1, 2022 (CN) ..... 202221674804.6

(51) Int. Cl.

| | |
|---|---|
| ***A24F 40/46*** | (2020.01) |
| ***A24F 40/10*** | (2020.01) |
| ***A24F 40/42*** | (2020.01) |
| ***A24F 40/485*** | (2020.01) |

(52) U.S. Cl.

CPC ..... *A24F 40/46* (2020.01); *A24F 40/10* (2020.01); *A24F 40/42* (2020.01); *A24F 40/485* (2020.01)

(58) Field of Classification Search

None

See application file for complete search history.

(56) References Cited

U.S. PATENT DOCUMENTS

| | | | | |
|---|---|---|---|---|
| 2017/0027230 | A1* | 2/2017 | Fornarelli | B65D 25/02 |
| 2020/0305509 | A1* | 10/2020 | Chen | A24F 40/10 |
| 2021/0030072 | A1 | 2/2021 | Fu et al. | |

FOREIGN PATENT DOCUMENTS

| | | | |
|---|---|---|---|
| CN | 206079041 | U | 4/2017 |
| CN | 111955802 | A | 11/2020 |
| CN | 211861815 | U | 11/2020 |
| CN | 215837104 | U | 2/2022 |
| CN | 216079737 | U | 3/2022 |

(Continued)

OTHER PUBLICATIONS

English machine translation of CN 212345299U; Lei et al., published Jan. 15, 2021; 32 pages. (Year: 2021).*

(Continued)

*Primary Examiner* — Linda L Gray

(57) ABSTRACT

The present disclosure provides a vaporization device and an electronic cigarette having same. The vaporization device includes a housing, a vaporization component, an air exchange passage, and a first sealing member. A liquid storage bin, an air passage, and a vaporization bin are arranged in the housing. The vaporization component includes a bracket and a vaporization core. The bracket has a top bracket surface facing the liquid storage bin. The top bracket surface is provided with a first air exchange groove. The first air exchange groove is provided with a first opening facing the liquid storage bin. The vaporization core is configured to vaporize the aerosol matrix and release an aerosol toward the vaporization bin. The air exchange passage includes a first segment and a second segment. The first segment is formed in the first air exchange groove.

18 Claims, 3 Drawing Sheets

(56) References Cited

FOREIGN PATENT DOCUMENTS

| | | | |
|---|---|---|---|
| CN | 114304754 | A | 4/2022 |
| CN | 114617306 | A | 6/2022 |
| CN | 217771469 | U | 11/2022 |
| WO | 2021237718 | A1 | 12/2021 |
| WO | 2022095771 | A1 | 5/2022 |
| WO | 2022099649 | A1 | 5/2022 |

OTHER PUBLICATIONS

International Search Report dated Sep. 15, 2023 in International Application No. PCT/CN2023/093671, English translation attached.
Extended European Search Report received in corresponding European Patent Application No. EP23182550.6, dated Dec. 15, 2023.

* cited by examiner

VAPORIZATION DEVICE AND ELECTRONIC CIGARETTE HAVING SAME

CROSS-REFERENCE TO RELATED APPLICATIONS

This application claims priority to Chinese patent application No. 202221674804.6, filed on Jul. 1, 2022, the entire disclosure of which is incorporated herein by reference.

FIELD

The present application relates to the field of electronic cigarette technologies, and specifically to a vaporization device and an electronic cigarette having the same.

BACKGROUND

With the increasingly stringent control and restriction of tobacco all over the world, electronic cigarettes, as a substitute for traditional tobacco, can not only simulate the sensory experience of smoking, but also do far less damage to health than smoking traditional tobacco, so the demand for electronic cigarettes is increasing year by year.

An electronic cigarette usually includes a cartridge and a power supply component. The cartridge is installed on the power supply component and can generate an aerosol for a human body to inhale. The cartridge includes a liquid storage bin, an air passage, a vaporization bin, and a vaporization core. The liquid storage bin is provided with an e-liquid for generating the aerosol. The e-liquid enters the vaporization bin through the vaporization core and is vaporized into the aerosol, and the aerosol is inhaled by the user through the air passage.

In the related art, as the amount of e-liquid in the liquid storage bin of the cartridge decreases after the cartridge is configured to a long time, a pressure difference is formed between the liquid storage bin and the vaporization bin, and the e-liquid cannot flow smoothly to the vaporization core for vaporization. As a result, the amount of aerosol generated in the vaporization bin is reduced, and an increased resistance is produced to inhalation of the user, affecting user experience.

SUMMARY

According to one aspect, the present disclosure provides a vaporization device, including:

a housing, where a liquid storage bin, an air passage, and a vaporization bin are arranged in the housing, the liquid storage bin is configured to store an aerosol matrix, the air passage is in communication with the vaporization bin, the housing is provided with an air inlet and an air outlet in communication with outside, the air inlet is in communication with the vaporization bin, and the air outlet is in communication with the air passage;

a vaporization component, fixed between the liquid storage bin and the vaporization bin, where the vaporization component includes a bracket and a vaporization core, the bracket has a top bracket surface facing the liquid storage bin, the top bracket surface is provided with a first air exchange groove, the first air exchange groove is provided with a first opening facing the liquid storage bin, and the vaporization core is configured to vaporize the aerosol matrix and release an aerosol toward the vaporization bin;

an air exchange passage, including a first segment and a second segment, where the first segment is formed in the first air exchange groove, and the second segment is in communication with the first segment and the vaporization bin; and a first sealing member, including a first sealing portion and an elastic sealing portion, where the first sealing portion is arranged between the vaporization component and the housing, the elastic sealing portion covers the first opening, and the elastic sealing portion is configured to open the first opening when a pressure difference between the first segment and the liquid storage bin is greater than a predetermined value, to communicate the first segment with the liquid storage bin.

In an embodiment, the first air exchange groove has a side groove wall, the side groove wall at least partially protrudes from the top bracket surface to form a rib, and the rib is configured to press against the elastic sealing portion.

In an embodiment, the first air exchange groove has a bottom groove wall and a top groove surface, the side groove wall is connected between the bottom groove wall and the top groove surface, and the top groove surface and the top bracket surface form a stepped surface.

In an embodiment, a distance between the top groove surface and the bottom groove wall is 3 to 5 times a distance between the top groove surface and the top bracket surface.

In an embodiment, the distance between the top groove surface and the bottom groove wall is 0.1 mm to 0.3 mm.

In an embodiment, a width of the top groove surface is 0.2 mm to 0.5 mm.

In an embodiment, the first air exchange groove has an open end located at an edge of the bracket, and the first segment is in communication with the second segment through the open end.

In an embodiment, the first sealing portion covers at least a part of an outer surface of the bracket.

In an embodiment, the second segment is defined between the first sealing portion and the bracket.

In an embodiment, an installation cavity and an air exchange cavity separated from each other are formed on the bracket, the vaporization component is fixedly installed in the installation cavity, the second segment is in communication with the air exchange cavity, and the air exchange cavity is in communication with the vaporization bin.

In an embodiment, the liquid storage bin and the vaporization bin are distributed along a first direction, and the air exchange cavity runs through a side surface of the bracket in the first direction.

In an embodiment, an air exchange hole and a second air exchange groove are formed on an outer peripheral surface of the bracket, the air exchange hole runs through an outer peripheral wall of the bracket and is in communication with an interior of the air exchange cavity, one end of the second air exchange groove is connected with the air exchange hole, and another end of the second air exchange groove runs through another side surface of the bracket in the first direction.

In an embodiment, the second segment is jointly defined between the second air exchange groove and the first sealing member.

In an embodiment, a length of the second air exchange groove is greater than a distance between the air exchange hole and the first air exchange groove.

In an embodiment, the second air exchange groove has a uniform cross-sectional area.

In an embodiment, a position of connection between the second air exchange groove and the air exchange hole is distant from the liquid storage bin relative to the air exchange hole.

In an embodiment, the present disclosure provides an electronic cigarette, which includes a power supply device and the vaporization device. The power supply device is configured to supply electric energy to the vaporization device.

According to another aspect, the present disclosure provides an electronic cigarette, which includes a power supply device and the vaporization device. The power supply device is configured to supply electric energy to the vaporization device.

Additional aspects and advantages of the present disclosure will be partly given in and partly apparent from the description below, or understood through practice of the present disclosure.

BRIEF DESCRIPTION OF THE DRAWINGS

The above and/or other additional aspects and advantages of the present disclosure become apparent and comprehensible from the description of embodiments in connection with accompanying drawings, in which.

LIST OF REFERENCE NUMERALS

100: vaporization device;

1: housing; 101: housing body; 102: base; 103: conductive pin; 11: liquid storage bin; 12: air passage; 13: vaporization bin; 14: air inlet; 15: air outlet;

2: vaporization component; 21: bracket; 211: top bracket surface; 2111: first air exchange groove; 21111: first opening; 21112: bottom groove wall; 21113: top groove surface; 21114: side groove wall; 2113: rib; 213: installation cavity; 215: air exchange cavity; 2171: air exchange hole; 2173: second air exchange groove; 21731: second opening; 23: vaporization core;

3: air exchange passage; 31: first segment; 32: second segment;

4: first sealing member; 41: first sealing portion; 42: second sealing portion; 43: elastic sealing portion;

5: second sealing member.

DETAILED DESCRIPTION

A vaporization device 100 according to an embodiment of a first aspect of the present disclosure will be described below with reference to FIG. 1 to FIG. 3.

Figure 1:
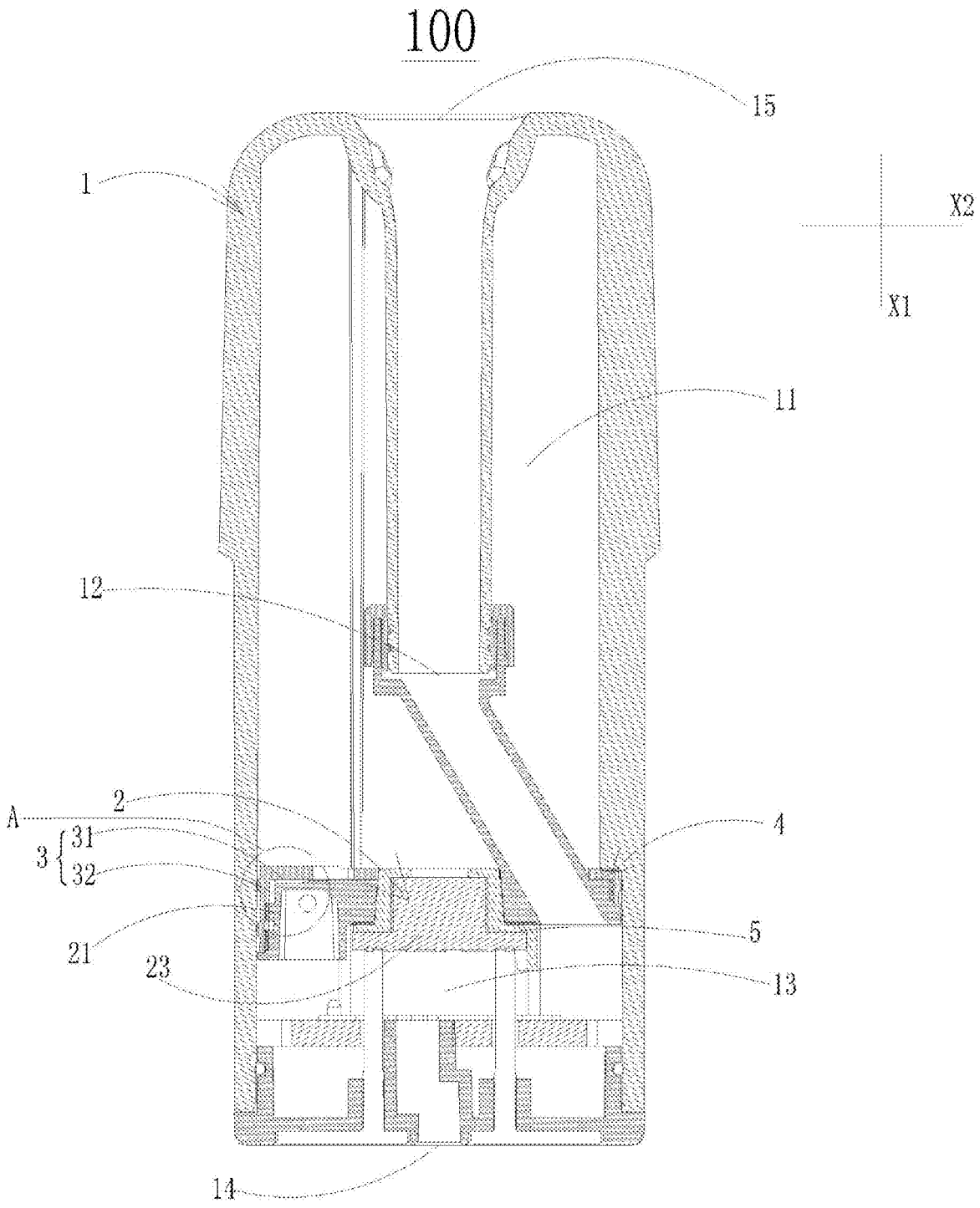
FIG. 1 is a schematic diagram of a vaporization device according to an embodiment of the present disclosure.
Figure 2:
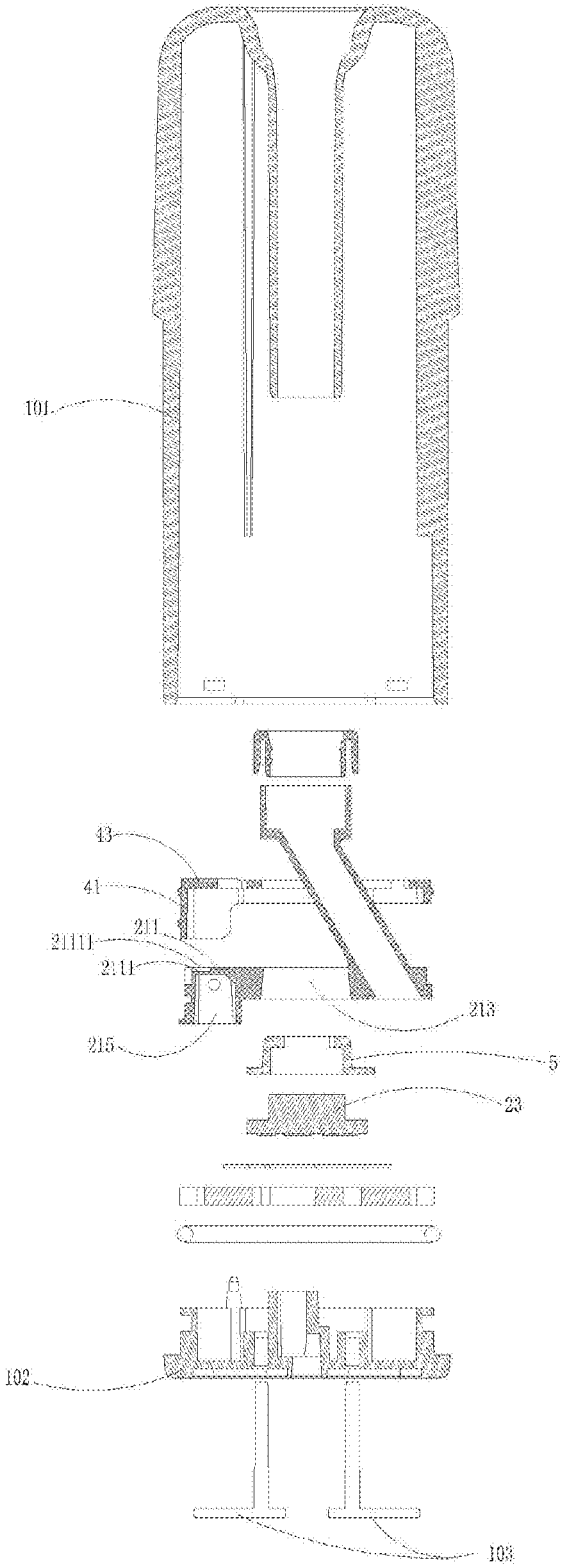
FIG. 2 is an exploded view of the vaporization device shown in FIG. 1.
Figure 3:
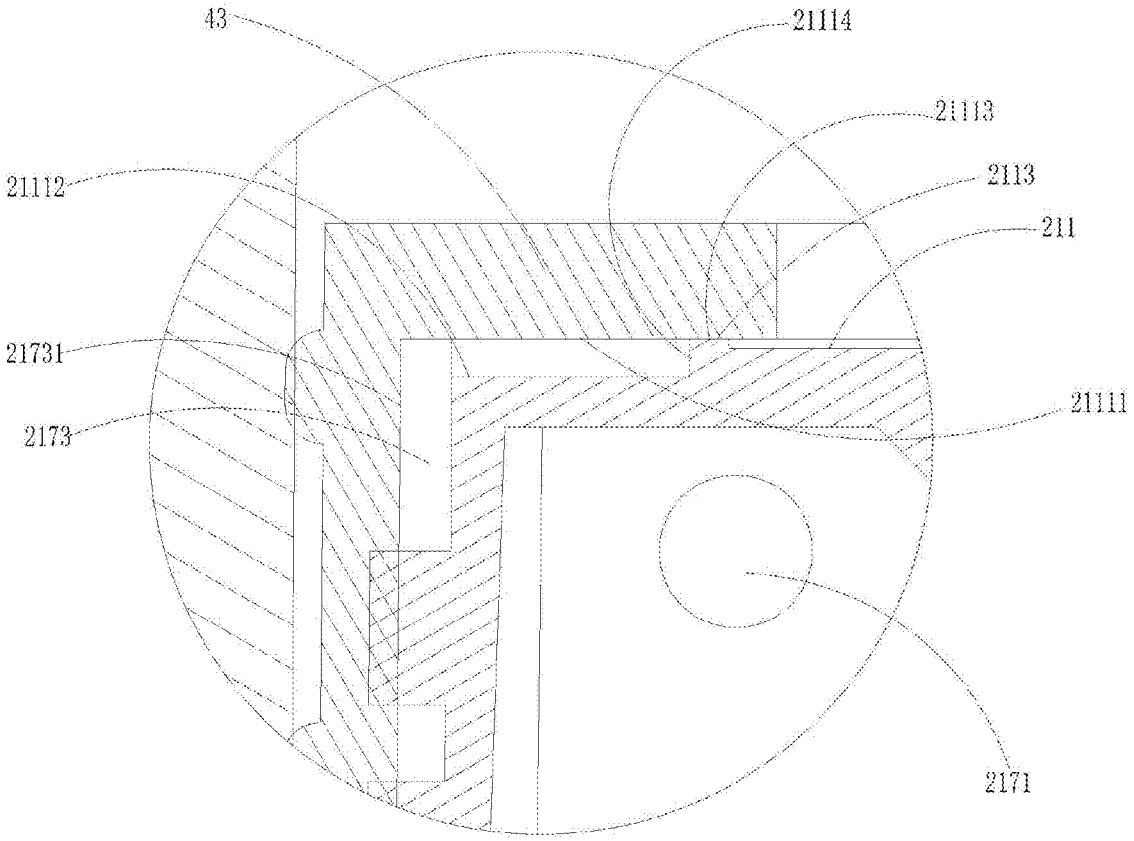
FIG. 3 is a partially enlarged view of part A in the vaporization device shown in FIG. 1.

As shown in FIG. 1 to FIG. 3, the vaporization device 100 according to the embodiment of the first aspect of the present disclosure includes a housing 1, a vaporization component 2, an air exchange passage 3, and a first sealing member 4.

A liquid storage bin 11, an air passage 12, and a vaporization bin 13 are arranged in the housing 1, the liquid storage bin 11 is configured to store an aerosol matrix, the air passage 12 is in communication with the vaporization bin 13, the housing 1 is provided with an air inlet 14 and an air outlet 15 in communication with outside, the air inlet 14 is in communication with the vaporization bin 13, and the air outlet 15 is in communication with the air passage 12.

The vaporization component 2 is arranged in the housing 1. The vaporization component 2 is fixed between the liquid storage bin 11 and the vaporization bin 13. The vaporization component 2 includes a bracket 21 and a vaporization core 23. The bracket has a top bracket surface 211 facing the liquid storage bin 11. The top bracket surface 211 is provided with a first air exchange groove 2111. The first air exchange groove 2111 is provided with a first opening 21111 facing the liquid storage bin 11. The bracket 21 is fixed to the housing 1. The vaporization core 23 is fixed to the bracket 21. The vaporization core 23 is configured to vaporize the aerosol matrix and release an aerosol toward the vaporization bin 13. Then a mixture of the aerosol and air can be transmitted through the air passage 12 to the air outlet 15 for a user to inhale.

The air exchange passage 3 includes a first segment 31 and a second segment 32. The first segment 31 is formed in the first air exchange groove 2111. The second segment 32 is in communication with the first segment 31 and the vaporization bin 13, so that the air in the vaporization bin 13 can enter the liquid storage bin 11 through the air exchange passage 3. It should be understood that the second segment 32 is a space in communication with the first segment 31 and the vaporization bin 13. In the present disclosure, the manner in which the second segment 32 is formed is not limited. The second segment may be formed by a tube, may be defined by a groove and a wall, or may be formed by a plurality of communicating spaces formed in various manners.

The first sealing member 4 includes a first sealing portion 41 and an elastic sealing portion 43. The first sealing portion 41 is arranged between the vaporization component 2 and the housing 1 to form a seal along a circumferential direction of the bracket 21, so as to prevent the aerosol matrix in the liquid storage bin 11 from leaking into the vaporization bin 13 through a gap between the bracket 21 and the housing 1. The elastic sealing portion 43 covers the first opening 21111. The elastic sealing portion 43 is made of an elastic material, such as silica gel, and can be elastically deformed under an external force. The elastic sealing portion 43 is configured to open the first opening 21111 when a pressure difference between the first segment 31 and the liquid storage bin 11 is greater than a predetermined value, so as to communicate the first segment 31 with the liquid storage bin 11. It should be understood that "the pressure difference between the first segment 31 and the liquid storage bin 11" means that the pressure in the first segment 31 is greater than the pressure in the liquid storage bin 11 and that the pressure difference between the first segment 31 and the liquid storage bin 11 is equal to the pressure in the first segment 31 minus the pressure in the liquid storage bin 11.

When the vaporization device 100 is in use, the vaporization core 23 adsorbs and vaporizes the aerosol matrix, and as the aerosol matrix in the liquid storage bin 11 is gradually consumed, the pressure in the liquid storage bin 11 gradually decreases. If the pressure in the liquid storage bin 11 cannot be increased, the pressure difference between the vaporization bin 13 and the liquid storage bin 11 becomes larger and larger, and the amount of e-liquid adsorbed by the vaporization core 23 decreases, affecting the efficiency of aerosol generation and substantially affecting the use of the vaporization device 100. In this embodiment, the vaporization bin 13 is in communication with outside through the air inlet 14, and the first segment 31 is in communication with the vaporization bin 13 through the second segment 32, so that the pressure in the first segment 31 is maintained at a stable atmospheric pressure. With the decrease of the pressure in the liquid storage bin 11, when the pressure difference between the first segment 31 and the liquid storage bin 11 reaches a predetermined value, the elastic sealing portion undergoes an elastic deformation under the action of the pressure, so that the first opening 21111 is in communication with the liquid storage bin 11, and air in the vaporization bin 13 can enter the liquid storage bin 11 through the air exchange passage 3. When the pressure difference is less than the predetermined value, the elastic sealing portion 43 recovers to cover the first opening 21111. It should be understood that the predetermined value may be set according to requirements by changing the structure and material of the elastic sealing portion 43. In this embodiment, the predetermined value is greater than 0.

In this embodiment, the first air exchange groove 2111 is arranged on the top bracket surface 211. Compared with a case where an air exchange groove is arranged only on a side surface of the bracket 21, the first air exchange groove 2111 on the top bracket surface 211 can increase the air intake area (the area of the first opening 21111), so that under the same pressure difference, the elastic sealing portion 43 receives a greater force and is easier to open for air exchange.

Further, the first air exchange groove 2111 has a bottom groove wall 21112, a top groove surface 21113, and a side groove wall 21114 therebetween. The side groove wall 21114 at least partially protrudes from the top bracket surface 211 to form a rib 2113. The rib 2113 is configured to press against the elastic sealing portion 43. When the elastic sealing portion 43 covers the first opening 21111, the rib 2113 presses against the elastic sealing portion 43.

When the side groove wall 21114 protrudes from the top bracket surface 211 to form the rib 2113, an end surface of the rib 2113 distant from the top bracket surface 211 forms the top groove surface 21113, that is, the top groove surface 21113 and the top bracket surface 211 are not coplanar, but form a stepped surface together. When the elastic sealing portion 43 covers the first opening 21111, a gap is formed between the elastic sealing portion 43 and the top bracket surface 211, to reduce the contact area between the elastic sealing portion 43 and the bracket 21 and make the elastic sealing portion 43 easier to open.

Further, a width of the top groove surface 21113 is 0.2 mm to 0.5 mm, preferably 0.2 mm, so that the bracket 21 and the elastic sealing portion 43 have a small contact area and are easy to open.

A depth of the first air exchange groove 2111 is greater than a height of the stepped surface, that is, a distance between the top groove surface 21113 and the bottom groove wall 21112 is greater than a distance between the top groove surface 21113 and the top bracket surface 211. In this way, the volume of air exchanged through the first air exchange groove 2111 can be increased thereby improving the air exchange efficiency. Preferably, a distance between the top groove surface 21113 and the bottom groove wall 21112 is 3 to 5 times a distance between the top groove surface 21113 and the top bracket surface 211.

In this embodiment, a depth of the first air exchange groove 2111 is 0.1 mm to 0.3 mm.

In an embodiment, the first air exchange groove 2111 has an open end (not numbered) located at an edge of the bracket 21, and the first segment 31 is in communication with the second segment 32 through the open end.

In an embodiment, the first sealing portion 41 covers at least a part of an outer surface of the bracket 21, the second segment 32 is defined between the first sealing portion 41 and the bracket 21, and the second segment 32 is in communication with the vaporization bin 13 from a side surface of the bracket 21.

It should be understood that the direct communication of the second segment 32 with the vaporization bin 13 from the side surface is merely an implementation of the present disclosure, and that "the second segment 32 is in communication with the vaporization bin 13" includes indirect communication between the second segment 32 and the vaporization bin 13. In the embodiment shown, An installation cavity 213 and an air exchange cavity 215 separated from each other are formed on the bracket 21, the vaporization component 2 is fixedly installed in the installation cavity 213, the second segment 32 is in communication with the air exchange cavity 215, and the air exchange cavity 215 is in communication with the vaporization bin 13, so that the second segment 32 and the vaporization bin 215 are indirectly in communication through the air exchange cavity 215.

For example, the liquid storage bin 11 and the vaporization bin 13 may be arranged along a first direction X1 of the housing 1, the vaporization component 2 is located between the liquid storage bin 11 and the vaporization bin 13, and the installation cavity 213 of the vaporization bin 13 is in communication with each of the liquid storage bin 11 and the vaporization bin 13. The air outlet 15 may be provided at the top of the housing 1 and in communication with the air passage 12, and the air inlet 14 may be provided at the bottom of the housing 1 and in communication with the vaporization bin 13. The installation cavity 213 and the air exchange cavity 215 may be spaced apart from each other along a second direction X2 of the bracket 21. The second direction X2 is perpendicular to the first direction X1. A shape of the installation cavity 213 matches a shape of the vaporization component 2 to securely install the vaporization component 2 on the bracket 21. The bracket 21 may form an interference fit with an inner wall surface of the housing 1 through the first sealing portion 41.

During operation of the vaporization device 100, when the aerosol matrix in the liquid storage bin 11 moves to the vaporization bin 13 through the vaporization component 2, the liquid storage bin 11 is in a negative pressure state. When the pressure difference reaches the predetermined value, the air in the vaporization bin 13 flow to the air exchange cavity 215 and flows into the liquid storage bin 11 through the second segment 32 and the first segment 31, so that a balance is maintained between the pressure of the liquid storage bin 11 and the pressure of the vaporization bin 13. Therefore, the aerosol matrix in the liquid storage bin 11 can continuously penetrate into the vaporization component 2, so that the vaporization component 2 can obtain a sufficient amount of the aerosol matrix to maintain the aerosol generation effect.

Further, as shown in FIG. 3, the elastic sealing portion 43 extends from the first sealing portion 41 along the second direction X2, and the elastic sealing portion 43 at least partially protrudes along the second direction X2 to form the rib 2113.

The operation process of the vaporization device 100 when used in an electronic cigarette is described by way of example below.

After the vaporization device 100 is combined with a power supply component, the user inhales through the air outlet 15. In this case, a pneumatic sensor (for example, an airflow sensor) in the power supply component detects the inhalation, and a power source in the power supply component is electrically connected to the vaporization component 2. The vaporization component 2 operates. For example, the vaporization component 2 performs heating. The aerosol matrix such as an e-liquid in the liquid storage bin 11 is adsorbed by the vaporization component 2 and heated by the vaporization component 2 to form an aerosol in the vaporization bin 13. At the same time, outside air enters the vaporization bin 13 through the air inlet 14 and is mixed with the aerosol in the vaporization bin 13. The mixture is inhaled by the user through the air passage 12 and the air outlet 15, thereby realizing a usage demand of the user. When the user stops inhaling through the air outlet 15, the aerosol matrix such as the e-liquid in the liquid storage bin 11 stops entering the vaporization component 2 from the liquid storage bin 11, so as to avoid useless consumption of the aerosol matrix in the liquid storage bin 11 and improve the utilization rate of the aerosol matrix. It needs to be explained herein that in some electronic cigarettes, the vaporization device 100 and the power supply component are configured as separate structures, which can be combined detachably, and in some electronic cigarettes, the vaporization device 100 and the power supply component are configured as a non-detachable structure. This is not specifically limited herein.

According to the vaporization device 100 of the embodiments of the present disclosure, the installation cavity 213 and the air exchange cavity 215 separated from each other are formed on the bracket 21, the vaporization component 2 is fixedly installed in the installation cavity 213, the air exchange cavity 215 is in communication with the vaporization bin 13, one end of the second segment 32 defined between the first sealing portion 41 and the bracket 21 is in communication with an interior of the air exchange cavity 215, and another end of the second segment 32 is in communication with the first segment 31. Therefore, when the vaporization device operates 100, the pressure difference between the liquid storage bin 11 and the vaporization bin 13 can be adjusted through the air exchange passage 3 to ensure that a balance is maintained between the pressure of the liquid storage bin 11 and the pressure of the vaporization bin 13 and the aerosol matrix in the liquid storage bin 11 can continuously move to the vaporization bin 13 through the vaporization component 2. In this way, the vaporization component 2 can obtain a sufficient amount of the aerosol matrix to maintain an aerosol generation effect, and the resistance to inhalation of the user can be reduced, thereby improving user experience.

In the embodiment shown, the air exchange cavity 215 runs through a side surface of the bracket 21 in the first direction X1. Therefore, the communication of the air exchange cavity 215 with the vaporization bin 13 is realized. When the pressure difference between the vaporization bin 13 and the liquid storage bin 11 reaches the predetermined value, the airflow in the vaporization bin 13 can flow to the first segment 31 through the air exchange cavity 215 and the second segment 32 and elastically deform the elastic sealing portion 43, so that the airflow in the vaporization bin 13 flows to the liquid storage bin 11, thereby effectively ensuring the balance between the pressure in the liquid storage bin 11 and the pressure in the vaporization bin 13.

According to some embodiments of the present disclosure, the vaporization component 2 includes a second sealing member 5, the vaporization core 23 includes a porous body and a heating body, and the second sealing member 5 is sleeved on an outer edge of the porous body. The porous body has a liquid adsorption surface close to the liquid storage bin 11 and a vaporization surface close to the vaporization bin, and the heating body is arranged on the vaporization surface. An extending direction from the liquid absorption surface to the vaporization surface is the first direction X1.

It should be understood that the configuration of the separate second sealing member 5 is only an implementation of the present disclosure. In some other embodiments, the second sealing member 5 may be omitted; instead, a second sealing portion (not shown) is integrally formed on the first sealing member 4, and the second sealing portion 42 is arranged between the bracket 21 and the vaporization core 23. On one hand, a seal is formed along a circumferential direction of the vaporization core 23, so as to prevent the aerosol matrix in the liquid storage bin 11 from leaking into the vaporization bin 13 through a gap between the bracket 21 and the vaporization core 23. On the other hand, the vaporization core 23 may form an interference fit with an inner wall surface of the bracket 21 through the second sealing portion 42.

According to some embodiments of the present disclosure, an air exchange hole 2171 and a second air exchange groove 2173 are formed on an outer peripheral surface of the bracket 21. The air exchange hole 2171 runs through an outer peripheral wall of the bracket 21 and is in communication with the interior of the air exchange cavity 215. The second air exchange groove 2173 has a second opening 21731. The first sealing portion 41 covers the second opening 21731 to jointly define the second segment 32 between the second air exchange groove 2173 and the first sealing portion 41. One end of the second air exchange groove 2173 is connected with the air exchange hole 2171. Another end of the second air exchange groove 2173 runs through another side surface of the bracket 21 in the first direction X1 and is in communication with an open end of the first air exchange groove 2111. The elastic sealing portion 43 normally blocks the another end of the second air exchange groove 2173 and the first opening 21111 of the first air exchange groove 2111. When the pressure difference between the vaporization bin 13 and the liquid storage bin 11 reaches the predetermined value, the airflow in the vaporization bin 13 can flow to the air exchange cavity 215, and the airflow in the air exchange cavity 215 can flow to the first segment 31 through the air exchange hole 2171 and the second segment 32 and push the elastic sealing portion 43 to elastically deform, so that the airflow in the vaporization bin 13 flows to the liquid storage bin 11, thereby adjusting the pressure difference between the liquid storage bin 11 and the vaporization bin 13.

In some optional embodiments, a length of the second air exchange groove 2173 is greater than a distance between the air exchange hole 2171 and the first air exchange groove 2111. For example, the air exchange hole 2171 is formed on one side of the bracket 21 in a third direction (not shown). The third direction is perpendicular to both the first direction X1 and the second direction X2. A part of the second air exchange groove 2173 extends to another side of the bracket 21 in the third direction, and the first air exchange groove 2111 is located at one end of the bracket 21 in the first direction X1. In this case, the second air exchange groove 2173 is in the shape of a polyline, so as to increase the length of the second air exchange groove 2173. Therefore, when the second segment 32 is opened, a small amount of the aerosol matrix can be stored in the second air exchange groove 2173, so that the aerosol matrix can be prevented from directly flowing to the vaporization bin 13, thereby preventing the user from inhaling the aerosol matrix and ensuring user experience.

In some optional embodiments, the second air exchange groove 2173 has a uniform cross-sectional area. Such a configuration ensures that the airflow can flow smoothly in the second air exchange groove 2173, so that when the pressure difference between the vaporization bin 13 and the liquid storage bin 11 is greater than the predetermined value, the airflow in the second air exchange groove 2173 can quickly push the elastic sealing portion 43, to quickly adjust the pressure in the liquid storage bin 11 and the pressure in the vaporization bin 13.

In some optional embodiments, a position of connection between the second air exchange groove 2173 and the air exchange hole 2171 is distant from the liquid storage bin 11 relative to the air exchange hole 2171. By such a configuration, when the e-liquid in the liquid storage bin 11 flows into the second air exchange groove 2173 and enters the vaporization bin 13 through the air exchange hole 2171, the flow of the e-liquid from the second air exchange groove 2173 to the air exchange hole 2171 is from a "lower position" to a "higher position" because the air exchange hole 2171 is at a higher position and is closer to the liquid storage bin 11. In this way, the aerosol matrix in the liquid storage bin 11 can be prevented from flowing into the vaporization bin 13 through the second air exchange groove 2173 and the air exchange hole 2171, thereby preventing the aerosol matrix from being inhaled by the user.

In the embodiment shown, the housing 1 includes a housing body 101 and a base 102. The housing body 101 and the base 102 jointly define an internal space. The vaporization component 2 is arranged in the internal space and divides the internal space into the liquid storage bin 11 and the vaporization bin 13 distributed along the first direction X1. A conductive pin 103 is arranged on the base 102. The conductive pin 103 penetrates through the base to extend into the internal space and is electrically connected with the heating body. After the vaporization device 100 is combined with a power supply device, the power supply device can supply power to the heating body through the conductive pin 103 to vaporize the aerosol matrix in the porous body.

An electronic cigarette (not shown in the figure) according to an embodiment of a second aspect of the present disclosure includes a power supply device and the vaporization device 100 according to the embodiment of the first aspect of the present disclosure. The power supply device is configured to supply electric energy to the vaporization device 100.

In the electronic cigarette according to the embodiment of the present disclosure, with the use of the vaporization device 100, the pressure in the liquid storage bin 11 and the pressure in the vaporization bin 13 can be balanced in a timely manner, to reduce the resistance to inhalation of the user, thereby improving user experience.

Other configurations and operations of the electronic cigarette according to the embodiments of the disclosure are known to those of ordinary skill in the art, and are not described in detail herein again.

In the description of the present disclosure, it should be understood that orientation or position relationships indicated by the terms such as "center", "length", "width", "thickness", "on", "below", "front", "rear", "left", "right", "top", "bottom", "inner", "outer", "axial", "radial", and "circumferential" are based on orientation or position relationships shown in the accompanying drawings, and are used only for ease and brevity of illustration and description, rather than indicating or implying that the mentioned apparatus or component need to have a particular orientation or need to be constructed and operated in a particular orientation. Therefore, such terms should not be construed as limiting of the present disclosure.

In the description of the present disclosure, it should be noted that, unless otherwise clearly specified and defined, the terms "mount", "connect", "couple", and variants thereof should be interpreted in a broad sense, for example, may be a fixed connection, a detachable connection, or an integral connection; may be a mechanical connection or an electrical connection; or may be a direct connection, an indirectly connection via an intermediate medium, or communication between the interiors of two components. For those of ordinary skill in the art, the specific meanings of the above terms in the present disclosure can be understood according to specific circumstances.

In the description of the specification, the description with reference to the terms such as "an embodiment", "some embodiments", "exemplary embodiments", "example", "specific example", and "some example" mean that specific features, structures, materials or characteristics described in connection with the embodiment or example are embraced in at least one embodiment or example of the present disclosure. In this specification, exemplary descriptions of the foregoing terms do not necessarily refer to the same embodiment or example.

Although the embodiments of the present disclosure have been shown and described, a person of ordinary skill in the art should understand that various changes, modifications, replacements and variations may be made to the embodiments without departing from the principles and spirit of the present disclosure, and the scope of the present disclosure is as defined by the appended claims and their equivalents.

What is claimed is:

1. A vaporization device, comprising:

a housing, wherein a liquid storage bin, an air passage, and a vaporization bin are disposed in the housing, the liquid storage bin is configured to store an aerosol matrix, the air passage is in communication with the vaporization bin, the housing is provided with an air inlet and an air outlet, the air inlet and the air outlet are both in communication with outside, the air inlet is in communication with the vaporization bin, and the air outlet is in communication with the air passage;

a vaporization component, fixed between the liquid storage bin and the vaporization bin, wherein the vaporization component comprises a bracket and a vaporization core, the bracket comprises a top bracket surface facing the liquid storage bin, the top bracket surface comprises a first air exchange groove, the first air exchange groove comprises a first opening facing to the liquid storage bin, and the vaporization core is configured to vaporize the aerosol matrix and release an aerosol toward the vaporization bin;

an air exchange passage, comprising a first segment and a second segment, wherein the first segment is formed in the first air exchange groove, and the second segment is in communication with each of the first segment and the vaporization bin; and a first sealing member, comprising a first sealing portion and an elastic sealing portion, wherein the first sealing portion is disposed between the vaporization component and the housing, the elastic sealing portion covers the first opening, and the elastic sealing portion is configured to open the first opening when a pressure difference between the first segment and the liquid storage bin is greater than a predetermined value, to communicate the first segment with the liquid storage bin, wherein the first air exchange groove comprises a side groove wall, the side groove wall at least partially protrudes from the top bracket surface to form a rib, and the rib is configured to press against the elastic sealing portion.

2. The vaporization device according to claim 1, wherein the first air exchange groove comprises a bottom groove wall and a top groove surface, the side groove wall is connected between the bottom groove wall and the top groove surface, and the top groove surface and the top bracket surface form a stepped surface.

3. The vaporization device according to claim 2, wherein a distance between the top groove surface and the bottom groove wall is 3 to 5 times a distance between the top groove surface and the top bracket surface.

4. The vaporization device according to claim 3, wherein the distance between the top groove surface and the bottom groove wall is 0.1 mm to 0.3 mm.

5. The vaporization device according to claim 2, wherein a width of the top groove surface is 0.2 mm to 0.5 mm.

6. The vaporization device according to claim 1, wherein the first air exchange groove comprises an open end located at an edge of the bracket, and the first segment is in communication with the second segment through the open end.

7. The vaporization device according to claim 1, wherein the first sealing portion covers at least a part of an outer surface of the bracket.

8. The vaporization device according to claim 7, wherein the second segment is defined between the first sealing portion and the bracket.

9. The vaporization device according to claim 1, wherein an installation cavity and an air exchange cavity separated from each other are formed on the bracket, the vaporization component is fixedly installed in the installation cavity, the second segment is in communication with the air exchange cavity, and the air exchange cavity is in communication with the vaporization bin.

10. The vaporization device according to claim 9, wherein the liquid storage bin and the vaporization bin are distributed along a first direction, and the air exchange cavity runs through a side surface of the bracket in the first direction.

11. The vaporization device according to claim 10, wherein an air exchange hole and a second air exchange groove are formed on an outer peripheral surface of the bracket, the air exchange hole runs through an outer peripheral wall of the bracket and is in communication with an interior of the air exchange cavity, one end of the second air exchange groove is connected with the air exchange hole, and another end of the second air exchange groove runs through another side surface of the bracket in the first direction.

12. The vaporization device according to claim 11, wherein the second segment is jointly defined between the second air exchange groove and the first sealing member.

13. The vaporization device according to claim 11, wherein a length of the second air exchange groove is greater than a distance between the air exchange hole and the first air exchange groove.

14. The vaporization device according to claim 11, wherein the second air exchange groove has a uniform cross-sectional area.

15. The vaporization device according to claim 11, wherein a position of connection between the second air exchange groove and the air exchange hole is distant from the liquid storage bin relative to the air exchange hole.

16. An electronic cigarette, comprising a power supply device and the vaporization device according to claim 1, wherein the power supply device is configured to supply electric energy to the vaporization device.

17. The electronic cigarette according to claim 16, wherein the first air exchange groove comprises a bottom groove wall and a top groove surface, the side groove wall is connected between the bottom groove wall and the top groove surface, and the top groove surface and the top bracket surface form a stepped surface.

18. The electronic cigarette according to claim 17, wherein a distance between the top groove surface and the bottom groove wall is 3 to 5 times a distance between the top groove surface and the top bracket surface.

* * * * *